United States Patent [19]

Huber et al.

[11] 4,036,095

[45] July 19, 1977

[54] ARRANGEMENT FOR SHEARING BLADES WITH CEMENTED HARD CARBIDE INSERTS

[75] Inventors: Joseph B. Huber, Acme; Thomas A. Brown, Greensburg, both of Pa.

[73] Assignee: Kennametal Inc., Latrobe, Pa.

[21] Appl. No.: 549,305

[22] Filed: Feb. 12, 1975

[51] Int. Cl.[2] ..... B26D 7/26

[52] U.S. Cl. ..... 83/674; 83/694; 83/700; 83/701

[58] Field of Search ..... 83/674, 694, 701, 640, 83/698, 699, 700; 29/95 A, 105 R, 96

[56] References Cited

U.S. PATENT DOCUMENTS

| | | | |
|---|---|---|---|
| 160,330 | 3/1875 | Jones | 83/694 |
| 331,934 | 12/1885 | Aiken | 83/694 |
| 1,947,181 | 2/1934 | Behrman | 83/694 X |
| 3,214,106 | 10/1965 | Gorman | 83/698 X |
| 3,289,517 | 12/1966 | Brombach et al. | 83/640 |
| 3,306,147 | 2/1967 | Goodman, Jr. | 83/674 X |
| 3,321,145 | 5/1967 | Gorman | 83/674 X |
| 3,844,008 | 10/1974 | Sletten | 29/96 |
| 3,894,322 | 7/1975 | Pano | 29/96 |

*Primary Examiner*—Frank T. Yost

*Attorney, Agent, or Firm*—Melvin A. Crosby; Lawrence R. Burns

[57] ABSTRACT

The present invention concerns anarrangement for shearing blades employing cemented hard carbide material inserts for use in shearing machines of both the rotary and guillotine type.

8 Claims, 6 Drawing Figures

ARRANGEMENT FOR SHEARING BLADES WITH CEMENTED HARD CARBIDE INSERTS

The present invention relates to sharing machines comprising two opposing and cooperating blades that produce an opening and closing motion relative to each other such that when the shear blades are in the open position stock material is fed into position between the opposing shear blades.

The closing action then brings the shear blades together causing the cutting edges of the shear blades to produce a shearing action on the stock material.

Specifically, the present invention relates to shearing machines of the guillotine type used to shear light gauge metal into predetermined lengths and to rotary shearing machines such as rotary scrap cutters where pieces of light gauge scrap metal are fed in and rapidly and indescriminately chopped into smaller and more uniform pieces.

Shearing machines of the nature with which the present invention is concerned have readily apparent conditions of wear at the cutting edges of the shear blades. Periodically, these cutting edges must be replaced in order to maintain maximum use of the power loading factors on the shearing machine and to produce a clean shear edge on the workpiece. Longer life and ease of replacement of the cutting edges on the shear blades are desired goals if it produces a minimum of down time on the machine and a minimum of expense in returning the shear blade cutting edge to its original condition.

Heretofore, prior art machines have employed solid tool steel shear blades having cutting edges formed thereon and being an integral part of the shear blade itself. Inefficiencies with this method are in the original fabricating cost of producing the shear blades with an integral cutting edge, the relatively short wear life of the cutting edges before regrind of cutting edges is required, combined with the fact that only a limited number of regrinds can be accomplished before the entire tool must be replaced.

The introduction of cemented hard carbide materials for use as the cutting edge is known in the prior art and significantly longer tool life has resulted from the shear blades.

This introduction of cemented hard carbide materials took several forms, one of which was to make the entire shear blade out of cemented hard carbide. Making the entire blade of solid carbide is the most expensive method of fabrication. Regrinding will allow only a small portion of the entire height of carbide to be used before the minimum size is reached and the entire length of carbide must be replaced. In shearing of heavy stock, it is sometimes necessary to use a solid carbide blade to withstand the heavy impact experienced by the blade.

This method produced longer operational tool life and offset the fabrication and refurbishment costs. However, maximum tool life was not achieved because the relative brittleness of the cemented hard carbide material produced cracking and shattering of the shear blades when operating conditions were not controlled tightly.

An advance in the prior art over this was the introduction of shear blades made of steel having a cemented hard carbide material inserts placed in a small longitudinal recess of the steel body. A known method of secure attachment between the steel holder and the cemented hard carbide is brazing, epoxying or bolting the two materials together.

Brazing enjoyed relative and immediate and economic success in that the operational life of the shear blades was increased over steel and refurbishment time decreased and costs were lower than a solid blade. The problems with the method, however, involved themselves with the difference of the coefficients of thermal expansion of the two dissimilar materials. The use of brazing compounds requires heating the two materials and after the brazing compound has been added allowing them to cool.

The coefficient of thermal expansion being greater for the cemented hard carbide materials meant that during the cooling period the cemented hard carbide materials would be subjected to tension stresses. Cemented hard carbides are very weak materially when in tension and very strong in compression. This fact lead to even further limitations on the lengths of cemented hard carbide inserts and less than stable conditions of the carbide even when successfully brazed in place on the holders.

In applications such as the machines concerned with the present invention where there is no excessive heat build-up around the cemented hard carbide material and the steel epoxy compounds, presented themselves as a logical solution to the inherent problems brazing encountered. The use of epoxy in these applications brought the operational tool life to its maximum and again provided economic benefits over the brazing. However, in almost all shearing operations, there is enough heat and impact to weaken the epoxy bond. Shear strength of epoxy is lower than attaching by brazing or retaining mechanically so there is always the danger of the insert becoming loose.

Drawbacks of using epoxy came in the refurbishment process as epoxy requires heat to break it down for removal of the cemented hard carbide insert and further requires cleaning to produce a surface that will accept and bond to further epoxy compounds.

In addition, the present invention overcomes further problems encountered with shearing blades of steel with hardened metal inserts no matter how attached. The present invention allows shimming of the hardened inserts as they become worn or need resharpening such that only the inserts need be ground as wear occurs. Previous devices, while having hardened inserts, required regrinding of the inserts and steel holder requiring replacement of the entire holder after a limited number of regrinds. The present invention overcomes this particular problem.

With the foregoing in mind, a primary object of the present invention is to provide an arrangement whereby replacement of the shear blade cutting insert is simple, expedient and direct.

A further object of the present invention is to increase the shear blade holder operational life and reduce the frequency of necessary replacement.

These and other objects and advantages of the present invention will become more apparent upon reference to the following detailed specification taken in connection with the accompanying drawings in which.

BRIEF SUMMARY OF THE INVENTION

According to the present invention, a bar-like holder adapted for incorporation in a shearing machine of the rotary or guillotine type is provided with a recess longitudinally along the cutting face of said bar-like holder in which a cemented hard carbide material is seated and securely held by a mechanical clamping means.

Said mechanical means of clamping comprising a wall portion of the bar-like holder having one face forming a boundary of the longitudinal recess and abutting the cemented hard carbide insert, a clearance space formed between the wall portion and the body of the bar-like holder, a bolt extending through said wall portion and threadedly engaging the body of said bar-like holder.

DETAILED DESCRIPTION OF THE INVENTION

Figure 1:
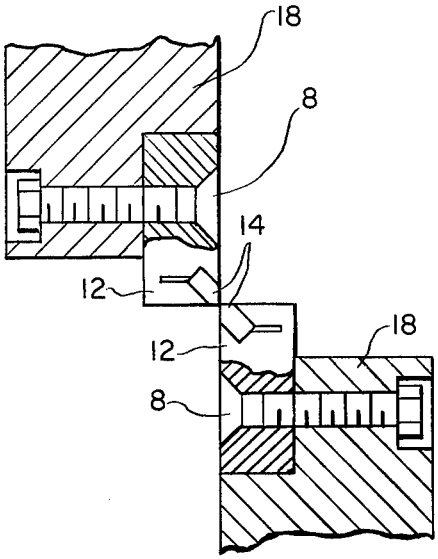
FIG. 1 shows the embodiment of the present invention in a side view of shear blades in a guillotine type shearing machine.

In FIG. 1, a guillotine type shearing machine is presented in which the power jaws 18 hold the bar-like holders 12 by some suitable clamping means 8 in a close relationship with each other. The jaws 18 are susceptible of many types of relative up and down motion. It is possible for the bottom power jaw 18 to be held stationary and the top power jaw 18 to move up and down against the workpiece or for the top power jaw 18 to remain stationary while the bottom jaw 18 moves upwardly to engage the workpiece or for both to move toward and away from each other simultaneously.

FIG. 1 shows the power jaws in a typical closed position such that the cutting edges of bar-like holder 12 are opposed to each other and a suitable clamping arrangement 8 holds bar-like holder 12 in place. The holders 12 each carry a cemented hard carbide material insert 14, preferably, a tungsten carbide composition.

Figure 2:
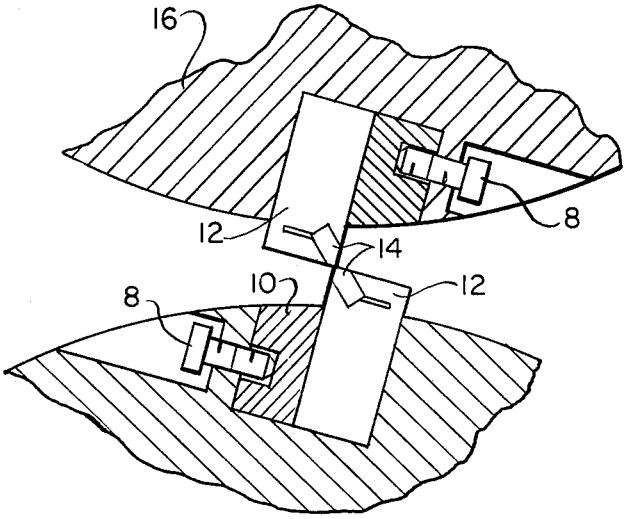
FIG. 2 shows the embodiment of the present invention in a side view of a rotary type shearing machine.

In FIG. 2, a rotary type shearing machine is presented with rotary power jaws 16 having a suitable clamping arrangement 8 and 10 for holding the bar-like holder 12 in place. Bar-like holder 12 is equipped with cutting inserts 14 which are made of cemented hard carbide material, preferably tungsten carbide. FIG. 2 shows the power jaws 16 in a closed configuration, it being understood that either power jaw may rotate and the other stay stationary or both may rotate cooperatively to engage the workpiece.

Figure 3:
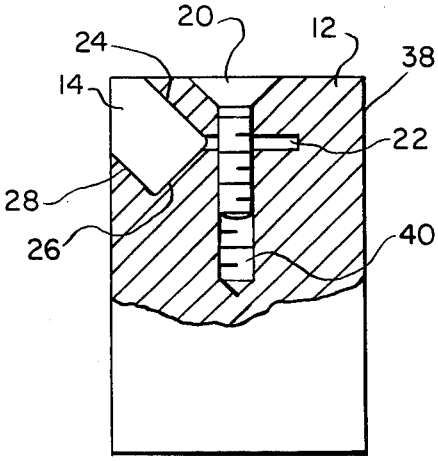
FIG. 3 shows a side view of a typical shear blade.

In FIG. 3 is shown a side view of the bar-like holder 12 with the cemented hard carbide insert 14 mechanically clamped in position. The details of the mechanical clamping means is shown herein in that the bar-like holder is recessed longitudinally and is bounded by a rearwardly inclined wall 28 and an outwardly facing wall 26 which abut corresponding walls on insert 14 when insert 14 is disposed in the bar-like holder 12.

A slot 22 is provided beginning at the intersection of outwardly facing wall 26 and forwardly inclined wall 24, said slot extending in the upward direction but not intersecting top wall 38 of bar-like holder 12. A hole 40 is formed by tapping and threading from the forward face of bar-like holder 12 through the slot 22 and rearwardly toward the back face of bar-like holder 12.

A tapered counterbore is provided in the forward face of bar holder 12 and centered upon the threaded hole 40 for engagement by a flat headed screw 20. The screw 20 is advanced into threaded engagement with hole 40, and as it is tightened, transmits a clamping force along forwardly inclined wall 24 of the longitudinal recess. Forwardly inclined wall 24 exerts or transmits this force to insert 14 to cause the insert firmly to seat against walls 26 and 28.

Figure 4:
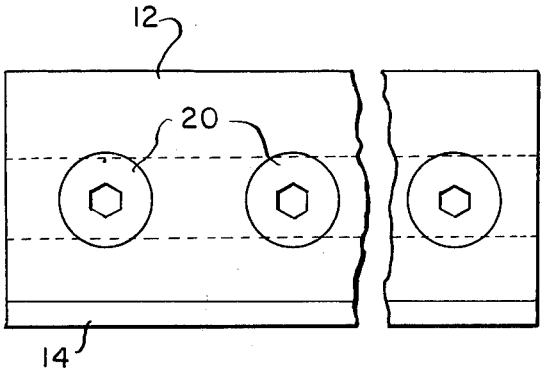
FIG. 4 shows a top view of FIG. 3.

FIG. 4 shows a top view of bar-like holder 12 and the arrangement of the screws 20 and cemented hard carbide insert 14. The spacing of the screws 20 can be as required for the clamping action thought to be necessary and the length of the insert 14 can be as long as the bar-like holder.

Figure 5:
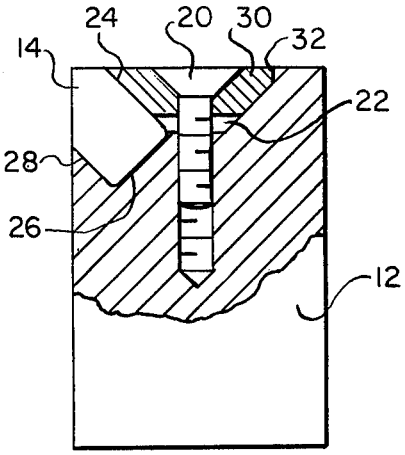
FIGS. 5 and 6 show an alternate construction of a typical shear blade.

FIG. 5 shows a side view of an alternate construction of the bar-like holder 12 where the wall portion 30 responsible for the clamping is not integrally connected to the body of the bar-like holder 12 but is a separate and distinct member. The operation and function are not altered to any great degree. Wall portion 30 is detachably connected to bar holder 12 by screw 20 which extends through wall portion 30 and threadedly engages the body of bar-like holder 12.

The longitudinal recess in bar-like holder 12 is bounded by rearwardly inclined wall 28, outwardly facing wall 26, and the forwardly inclined wall 24 is provided by one face of detachable wall portion 30. A clearance space 22 is still provided between the detachable wall portion 30 and the body of the bar-like holder 12 such that when screw 20 is threadedly advanced, clamping action occurs in the same manner as described in FIG. 3.

In FIG. 3, there is shown an abutting wall region 32 of bar-like holder 12 that abuts one face of detachable wall portion 30. Abutting region 32 is optional and may or may not be used depending on the scope of work to be performed.

Figure 6:
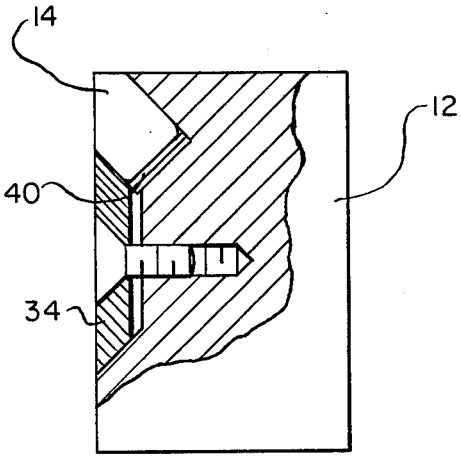

FIG. 6 shows another optional construction of bar-like holder 12 wherein the adjustable wall portion 34 is positioned on a side face of bar-like holder 12 with the wall portion 34 still abutting the insert 14 and clamping said insert in place. Also shown in FIG. 6 are shim plates 40 which can be placed under insert 14, thus, advancing the insert as it becomes worn or has been reground, it being understood the shimming feature can be employed in any of the configurations shown in FIGS. 1 to 6. This feature permits the insert to be maintained in a sharpened condition without reworking or regrinding of the holder.

The location of the slot for this feature is best when its centerline extends diagonally from a corner of said holder inward.

Modifications may be made within the scope of the appended claims.

We claim:

1. In a shearing blade, especially for shearing metal, the shearing blade being substantially rectangular in cross section and of a length which is a multiple of any lateral dimension thereof and comprising: a holder in the form of a bar, said bar having a longitudinal generally rectangular recess formed therein along one corner, said recess extending diagonally into the holder and having an outwardly facing bottom wall and two opposed side walls and being open on the outer side, an elongated cutting insert of a cemented hard metal carbide material seated in said recess and having a sharp corner along the open side of the recess forming a cutting edge on said insert, one of said opposed side walls forming an integrally connected movable wall portion adjacent said recess, a slot formed along said recess at the juncture of said movable wall portion and said bottom wall of said slot, said movable wall portion having a through hole and seat region transverse to the plane of the slot and within the range of said slot, and a bolt means extending through the movable wall portion and said holder such that advancing said bolt moves said opposed side walls relatively closer together clamping said insert and holding said insert compressively when said holder is in shearing operation.

2. A shearing blade according to claim 1 in which said elongated cutting insert is formed of a tungsten carbide material.

3. A shearing blade according to claim 1 which includes shims disposed in said recess between the hard wear resistant insert and a wall of the recess.

4. A shearing blade according to claim 1 in which said movable wall portion has end wall regions forming cooperating elements of abutment thereof, for abutment with the insert and the holder.

5. A shearing blade according to claim 4 in which said end wall regions of cooperating abutment converge in the direction of threaded bolt advancement for clamping means.

6. A shearing blade, especially for shearing metal, said shearing blade being substantially rectangular in cross section and of a length which is a multiple of any lateral dimension thereof and comprising; a holder in the form of a bar, said bar having a longitudinal generally rectangular recess formed therein along one corner, said recess extending diagonally into the holder and comprising an outwardly facing bottom wall and opposed side walls and being open on the outer side; a slot formed near the juncture of one of said opposed side walls and said bottom wall so that one of said side walls is resiliently movable relative to the other, an elongated cutting insert of hard wear resistant material seated in said recess and having a corner protruding from the open side of the recess; a longitudinal cutting edge formed on said corner; a through hole and seat region on said resiliently movable side wall, said through hole and seat having an axis transverse to the plane of said slot and within the range of said slot, and a bolt extending through said through hole and threadedly engaging said holder and clamping said insert between said opposed side walls.

7. A shearing blade according to claim 6 in which said elongated cutting insert is formed of a cemented hard carbide material.

8. A shearing blade according to claim 6 which includes shims disposed in said recess between the hard wear resistant insert and a wall of the recess.

* * * * *